US010633205B2

(12) United States Patent
Murata

(10) Patent No.: US 10,633,205 B2
(45) Date of Patent: Apr. 28, 2020

(54) SHEET FEEDING APPARATUS AND IMAGE FORMING APPARATUS

(71) Applicant: CANON KABUSHIKI KAISHA, Tokyo (JP)

(72) Inventor: Wataru Murata, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/107,549

(22) Filed: Aug. 21, 2018

(65) Prior Publication Data

US 2019/0062082 A1 Feb. 28, 2019

(30) Foreign Application Priority Data

Aug. 31, 2017 (JP) ..... 2017-168072

(51) Int. Cl.
*B65H 3/52* (2006.01)
*B65H 3/06* (2006.01)
(Continued)

(52) U.S. Cl.
CPC ..... *B65H 3/5223* (2013.01); *B65H 1/04* (2013.01); *B65H 1/08* (2013.01); *B65H 3/0638* (2013.01);
(Continued)

(58) Field of Classification Search
CPC ..... B65H 1/04; B65H 3/0661; B65H 3/34; B65H 3/52; B65H 3/5207; B65H 3/5215; B65H 3/5223; B65H 2405/111; B65H 2405/1111; B65H 2405/1114; B65H 2405/11141; B65H 2405/11152; B65H 2405/11161; B65H 2405/112; B65H 2405/1118; B65H 2405/332;
(Continued)

(56) References Cited

U.S. PATENT DOCUMENTS 5,951,003 A * 9/1999 Nojima ..... B65H 1/04 271/121
2006/0232000 A1* 10/2006 Takahashi ..... B65H 5/00 271/145

(Continued)

FOREIGN PATENT DOCUMENTS

JP 2007031093 A 2/2007
JP 2010013276 A 1/2010

*Primary Examiner* — Prasad V Gokhale
(74) *Attorney, Agent, or Firm* — Venable LLP

(57) ABSTRACT

A sheet feeding apparatus includes a sheet supporting portion including a supporting surface, an abutment portion against which a leading edge of the sheet abuts, a feeding rotator configured to feed the sheet, and a first friction member provided on the supporting surface so as to face the feeding rotator. The first friction member includes a first friction surface having a static friction coefficient greater than that of the supporting surface, a trailing end supporting portion configured to support a trailing end portion of the sheet curved upward, and a second friction member disposed upstream of the first friction member in the sheet feeding direction on the supporting surface. The second friction member includes a second friction surface which has a static friction coefficient greater than that of the supporting surface and is configured to be in contact with the sheet supported by the supporting surface.

15 Claims, 9 Drawing Sheets

(51) Int. Cl.

| | |
|---|---|
| ***B65H 1/08*** | (2006.01) |
| ***B65H 1/04*** | (2006.01) |
| ***B65H 3/34*** | (2006.01) |
| *B65H 1/26* | (2006.01) |

(52) U.S. Cl.
CPC ..... *B65H 3/0661* (2013.01); *B65H 3/0669* (2013.01); *B65H 3/34* (2013.01); *B65H 3/5215* (2013.01); *B65H 1/266* (2013.01); *B65H 2301/12* (2013.01); *B65H 2405/11* (2013.01); *B65H 2405/112* (2013.01); *B65H 2405/1111* (2013.01); *B65H 2405/1115* (2013.01); *B65H 2405/1118* (2013.01); *B65H 2405/11152* (2013.01); *B65H 2405/11161* (2013.01); *B65H 2405/32* (2013.01); *B65H 2405/324* (2013.01); *B65H 2405/332* (2013.01); *B65H 2407/21* (2013.01); *B65H 2701/11312* (2013.01)

(58) Field of Classification Search
CPC ..... B65H 2407/21; B65H 2511/11; B65H 2511/112; B65H 2701/11312
See application file for complete search history.

(56) References Cited

U.S. PATENT DOCUMENTS

| | | | | |
|---|---|---|---|---|
| 2009/0080957 | A1* | 3/2009 | Kano | B65H 1/266 399/405 |
| 2013/0106043 | A1* | 5/2013 | Murakami | B65H 1/04 271/9.01 |
| 2015/0084263 | A1* | 3/2015 | Kanzawa | B65H 1/14 271/3.2 |
| 2016/0291520 | A1* | 10/2016 | Tatematsu | B65H 1/266 |
| 2016/0347570 | A1* | 12/2016 | Sugiyama | B65H 3/0684 |
| 2018/0305147 | A1* | 10/2018 | Kuriki | B65H 3/0676 |

* cited by examiner

SHEET FEEDING APPARATUS AND IMAGE FORMING APPARATUS

BACKGROUND OF THE INVENTION

Field of the Invention

The present invention relates to a sheet feeding apparatus configured to feed a sheet and relates to an image forming apparatus comprising the same.

Description of the Related Art

In general, an image forming apparatus such as a printer is configured to be able to feed sheets of plural sizes, to store fixed size sheets such as A4 and B5 in cassettes and to place a sheet lengthy in a conveyance direction (referred to as a 'long sheet' hereinafter) on a manual sheet feeding tray.

Japanese Patent Application Laid-open No. 2007-031093 proposes an image forming apparatus comprising a manual sheet feeding tray, composed of a first holding portion holding a front part of a long sheet and a second holding portion holding a rear part of the long sheet, and a guide portion keeping a posture of a middle part of the long sheet and provided integrally with the first holding portion. While the long sheet is stored in a posture of curling upward by these first and second holding portions and the guide portion, a force of pushing the long sheet into a feed roller pair (referred to as a 'push-in force' hereinafter) acts on a leading edge of the long sheet due to a reaction force of the long sheet and gravity. If the push-in force is strong, the leading edge of the long sheet moves through a nip of the feed roller pair, possibly causing a feeding failure. Therefore, Japanese Patent Application Laid-open No. 2010-013276 proposes an image forming apparatus comprising a first holding portion holding the front part of the long sheet and provided with a concave portion to reduce the push-in force by curving the long sheet downward by the concave portion.

However, the concave portion is required to be large in order to fully curve the long sheet in the image forming apparatus of Japanese Patent Application Laid-open No. 2010-013276, causing a problem that the apparatus is enlarged. In a case where the long sheet is highly rigid in particular, the long sheet is hardly curved at the concave portion and the push-in force is not fully reduced, possibly causing a feeding failure.

SUMMARY OF THE INVENTION

According to a first aspect of the present invention, a sheet feeding apparatus includes a sheet supporting portion including a supporting surface configured to support a sheet, an abutment portion against which a leading edge of the sheet supported by the supporting surface abuts, a feeding rotator configured to feed the sheet supported by the supporting surface and abutting against the abutment portion in a sheet feeding direction, a first friction member provided on the supporting surface so as to face the feeding rotator, the first friction member including a first friction surface having a static friction coefficient greater than that of the supporting surface, a trailing end supporting portion configured to support a trailing end portion of the sheet curved upward by being supported by the sheet supporting portion, and a second friction member disposed upstream of the first friction member in the sheet feeding direction on the supporting surface, the second friction member including a second friction surface which has a static friction coefficient greater than that of the supporting surface and is configured to be in contact with the sheet supported by the supporting surface.

According to a second aspect of the present invention, a sheet feeding apparatus includes a first tray configured to support a sheet, an abutment portion against which a leading edge of the sheet supported by the first tray abuts, a feeding rotator configured to feed the sheet supported by the first tray and abutting against the abutment portion in a sheet feeding direction, a second tray configured to support a trailing end portion of the sheet supported by the first tray, an intermediate guide including a guide surface configured to guide the sheet so as to be curved upward between the first tray and the second tray, and a resistant portion provided on the intermediate guide so as to project out of the guide surface.

Further features of the present invention will become apparent from the following description of exemplary embodiments with reference to the attached drawings.

DESCRIPTION OF THE EMBODIMENTS

First Embodiment

Overall Configuration

Figure 1:
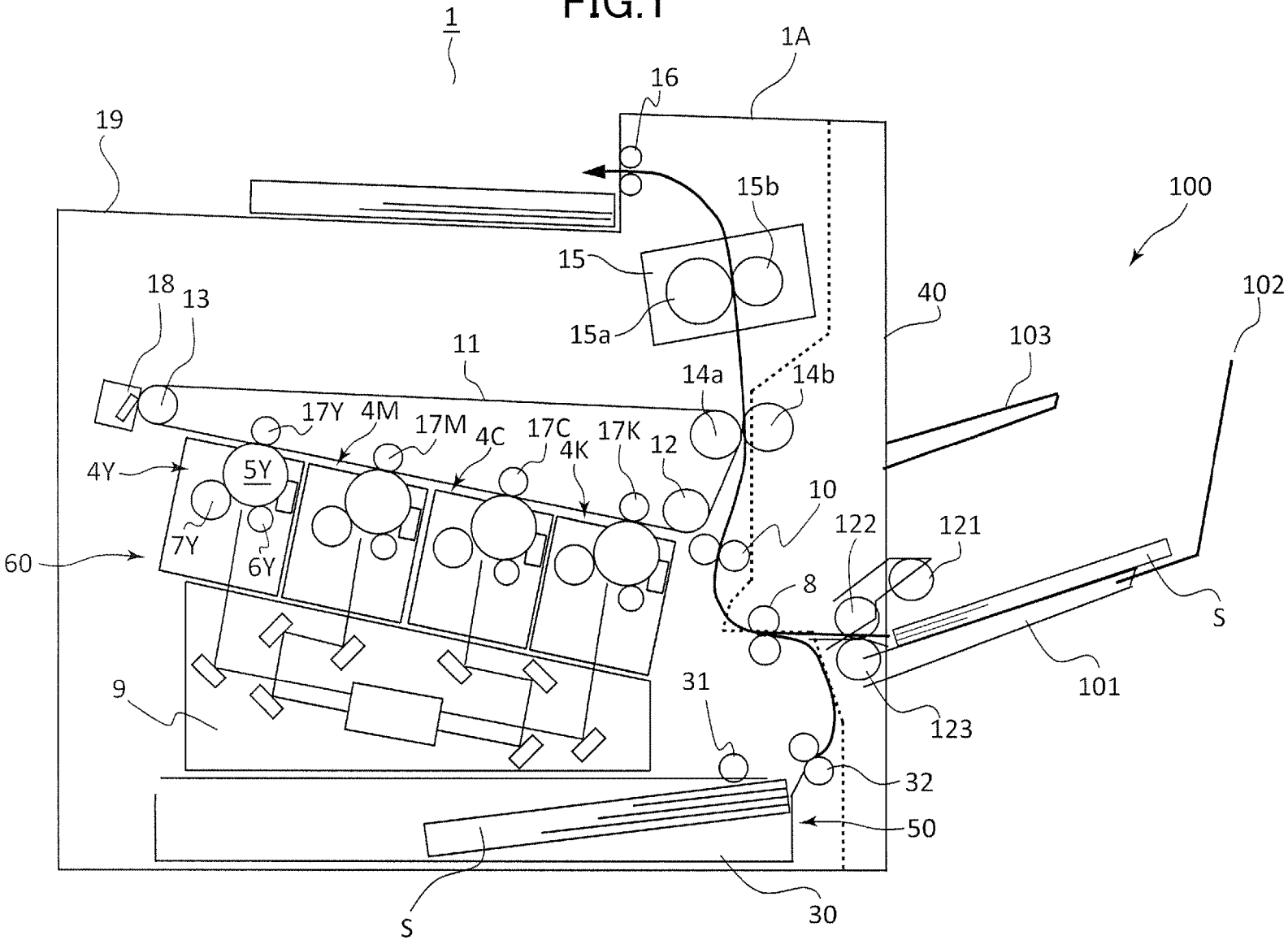
FIG. 1 is a schematic diagram illustrating an overall configuration of a printer of a first embodiment.

At first, a first embodiment of the present disclosure will be described. A printer 1 serving as an image forming apparatus of the first embodiment is an electro-photographic laser beam printer. As illustrated in FIG. 1, the printer 1 includes an image forming portion 60 configured to form an image on a sheet S, a cassette feeding apparatus 50, a manual sheet feeding apparatus 100, a fixing unit 15 and a discharge roller pair 16. The image forming portion 60 includes a scanner unit 9, and four process cartridges 4Y, 4M, 4C and 4K configured to form four color toner images of yellow (Y), magenta (M), cyan (C) and black (K), respectively. These four process cartridges 4Y, 4M, 4C and 4K are arrayed in a row approximately in a horizontal direction.

It is noted that the four process cartridges 4Y, 4M, 4C and 4K have the same configuration except of that colors of the images to be formed are different. Due to that, only the configuration and an image forming process of the process cartridge 4Y will be described below, and description of the process cartridges 4M, 4C and 4K will be omitted here.

The process cartridge 4Y includes a photosensitive drum 5Y, a charging roller 6Y and a developing roller 7Y. The photosensitive drum 5Y is composed of an aluminum cylinder around which an organic photoconductive layer is coated and is rotated by a driving motor not illustrated. Disposed above the process cartridges 4Y, 4M, 4C and 4K is an intermediate transfer belt 11. The intermediate transfer belt 11 is wrapped around a driving roller 12, a secondary transfer counter roller 14*a* and a tension roller 13, and a cleaning unit 18 is provided so as to face the tension roller 13.

Provided inside of the intermediate transfer belt 11 are primary transfer rollers 17Y, 17M, 17C and 17K. Provided on an opposite side of the secondary transfer counter roller 14*a* by interposing the intermediate transfer belt 11 is a secondary transfer roller 14*b*. The fixing unit 15 includes a fixing roller 15*a* heated by a heater and a pressure roller 15*b* in pressure contact with the fixing roller 15*a*. The cassette feeding apparatus 50 is provided at a lower part of the printer 1 and includes a cassette 30 storing a sheet S. The sheet S stored in the cassette 30 is fed by a pickup roller 31 and is separated from another sheet by a separation roller pair 32. A body 1A of the printer 1 openably supports a right door 40. By opening the right door 40, it becomes possible to remove a jammed sheet by opening a part of a sheet conveyance path through which the sheet is conveyed.

Next, an image forming operation of the printer 1 constructed as described above will be described. When an image signal is inputted to the scanner unit 9 from a personal computer or the like not illustrated, the photosensitive drum 5Y of the process cartridge 4Y is irradiated with a laser beam outputted from the scanner unit 9 corresponding to the image signal.

At this time, a surface of the photosensitive drum 5Y is charged homogeneously with predetermined polarity and potential in advance by the charging roller 6Y, and an electrostatic latent image is formed on the surface of the photosensitive drum 5Y by the irradiation of the laser beam from the scanner unit 9. The electrostatic latent image formed on the photosensitive drum 5Y is developed by the developing roller 7Y and a toner image of yellow (Y) is thus formed on the surface of the photosensitive drum 5Y.

In the same manner, each of the photosensitive drums of the process cartridges 4M, 4C and 4K is irradiated with the laser beam from the scanner unit 9, and toner images of magenta (M), cyan (C) and black (K) are formed on the respective photosensitive drums. The toner images of the respective colors formed on the respective photosensitive drums are transferred onto the intermediate transfer belt 11 by the primary transfer rollers 17Y, 17M, 17C and 17K and are conveyed to the secondary transfer roller 14*b* by the intermediate transfer belt 11 rotated by the driving roller 12. It is noted that image forming processes of the respective colors are performed with timing of superimposing onto an upstream toner image primarily transferred onto the intermediate transfer belt 11.

In parallel with the image forming process, a skew of the sheet S delivered out of the cassette feeding apparatus 50 or the manual sheet feeding apparatus 100 is corrected by a registration roller pair 8. The registration roller pair 8 also conveys the sheet S toward the secondary transfer roller 14*b* by synchronizing with the toner image conveyed by the intermediate transfer belt 11. A full-color toner image on the intermediate transfer belt 11 is transferred onto the sheet S at a nip formed by the secondary transfer counter roller 14*a* and the secondary transfer roller 14*b* by a secondary transfer bias applied to the secondary transfer roller 14*b*. Toner left on the intermediate transfer belt 11 after the transfer of the toner image is removed by the cleaning unit 18.

Then, the fixing roller 15*a* and the pressure roller 15*b* of the fixing unit 15 apply predetermined heat and pressure to the sheet S onto which the toner image has been transferred to melt and adhere, i.e., to fix, the toner. The sheet S which has passed through the fixing unit 15 is discharged onto a discharge tray 19 by a discharge roller pair 16.

Manual Sheet Feeding Apparatus

Figure 2:
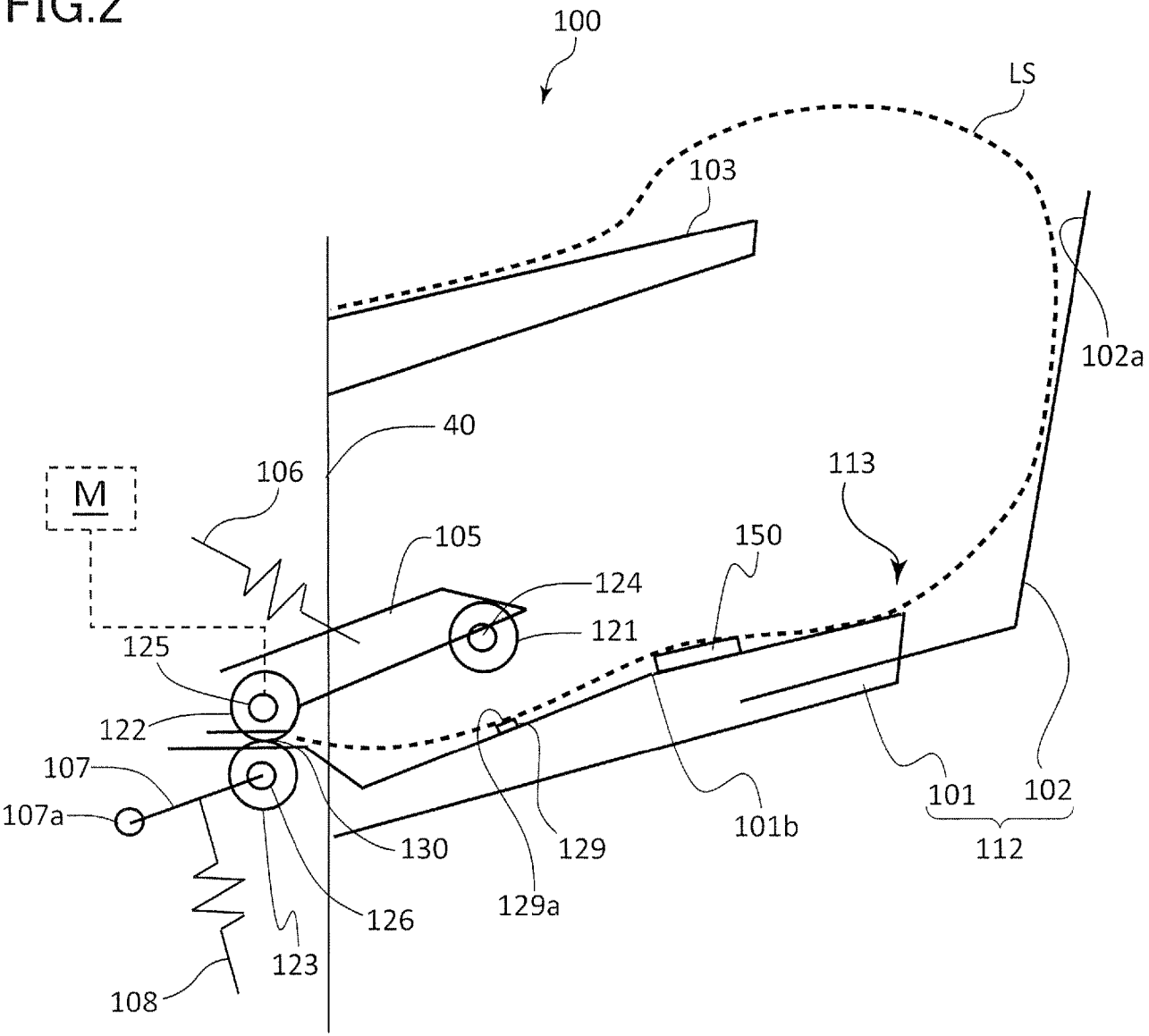
FIG. 2 is a side view illustrating a manual sheet feeding apparatus in a condition in which a pickup roller is located at a separate position.

Next, the manual sheet feeding apparatus 100 will be described with reference to FIGS. 2 and 3. As illustrated in FIG. 2, the manual sheet feeding apparatus 100 includes a tray unit 112, a rear end tray 103, the pickup roller 121, the feed roller 122 and a separation roller 123. The feed roller 122 is rotably supported by a rotary shaft 125 supported by a feed frame not illustrated, and the rotary shaft 125 turnably supports a feed arm 105. The feed arm 105 is configured to move up and down by a lift portion not illustrated and is provided with the pickup roller 121 rotably centering on a rotary shaft 124 at a distal end of the feed arm 105.

Figure 3:
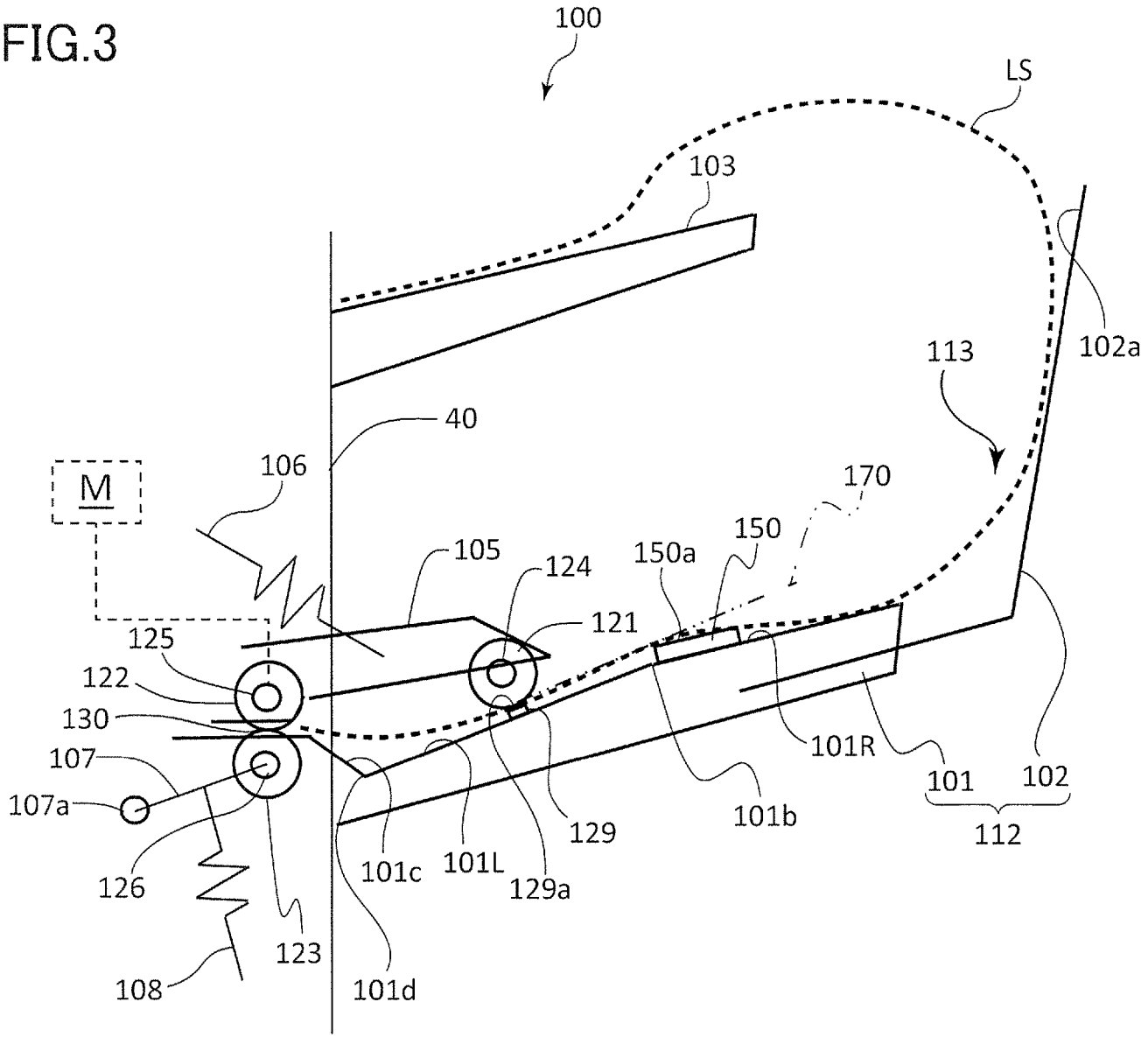
FIG. 3 is a side view illustrating the manual sheet feeding apparatus in a condition in which the pickup roller is located at a feed position.

The pickup roller 121 serving as a feeding rotator can be moved between a separate position, i.e., a position indicated in FIG. 2, and a feed position, i.e., a position indicated in FIG. 3, by the feed arm 105 that moves up and down. The pickup roller 121 separates from a sheet placed on the tray unit 112 in the separate position and comes into contact with a sheet placed on the tray unit 112 in the feed position. A pressure spring 106 is stretched between the feed arm 105 and the feed frame not illustrated to apply predetermined feed pressure to the pickup roller 121 located at the feed position. It is noted that the pickup roller 121 may be configured not only by the roller but another rotator such as a belt.

A driving force is inputted to the rotary shaft 125 of the feed roller 122 from a motor M. The driving force of the motor M inputted to the rotary shaft 125 is transmitted to the pickup roller 121 through a gear train supported by the feed arm 105 and not illustrated. The separation roller 123 is rotably supported by the rotary shaft 126 through a torque limiter not illustrated, and the rotary shaft 126 is supported by a separation roller holder 107 swingable centering on a swing shaft 107*a*. The separation roller holder 107 is urged by a pressure spring 108 such that the separation roller 123 comes into contact with the feed roller 122 with predetermined pressure by an urging force of the pressure spring 108. The feed roller 122 and the separation roller 123 form a separations nip 130 serving as an abutment portion.

When an image forming job using the manual sheet feeding apparatus 100 as a feed source is inputted, the pickup roller 121 drops from the separate position to the feed position and comes into contact with the sheet placed on the tray unit 112 as illustrated in FIG. 3. At this time, a leading edge of the sheet placed on the tray unit 112 abuts against an abutment member 160 (see FIGS. 5 and 6). There is a case where a leading edge of a following sheet which is multi-fed with a preceding sheet abuts against the separation nip 130. When the motor M is driven in this condition, the sheet placed on the tray unit 112 is fed by the pickup roller 121.

In a case where only one sheet is fed by the pickup roller 121, the torque limiter provided between the rotary shaft 126 and the separation roller 123 idles, and the separation roller 123 rotates following the feed roller 122. In a case where two or more sheets are fed by the pickup roller 121, the separation roller 123 stops its rotation to block the second sheet and thereafter from being conveyed. The feed roller 122 and the separation roller 123 compose a separating portion. It is noted that a drive in a direction opposite to the sheet feeding direction may be inputted to the separation roller 123 or a separation pad may be provided instead of the separation roller 123 to separate the sheet from another sheet.

Main Tray and Rear End Tray

Next, a tray unit 112 and a rear end tray 103 will be described in detail. A case where a long sheet LS is placed on the tray unit 112 and the rear end tray 103 will be also described below. As illustrated in FIG. 3, the tray unit 112 serving as a sheet supporting portion is composed of a manual feed tray 101 serving as a first tray and an intermediate guide 102. The intermediate guide 102 is fixed at a distal end portion of the manual feed tray 101 and is inclined upward toward upstream in the sheet feeding direction. The intermediate guide 102 includes a guide surface 102*a* that guides the long sheet LS so as to be curved upward between the manual feed tray 101 and the rear end tray 103.

The manual feed tray 101 serving as a tray is turnably supported by the right door 40, and the rear end tray 103 serving as a second tray (or trailing end supporting portion) is removably fixed to the right door 40 so as to overlap with the manual feed tray 101 when viewed in a perpendicular direction. The manual feed tray 101, the intermediate guide 102 and the rear end tray 103 are formed of resin or sheet metal. The manual feed tray 101 includes a first surface 101L disposed under the pickup roller 121, a second surface 101R disposed upstream of the first surface 101L in the sheet feeding direction and a third surface 101*c* disposed downstream of the first surface 101L. The first surface 101L is inclined downward toward the separation nip 130, and the second surface 101R is inclined downward toward the separation nip 130 with an inclination angle smaller than that of the first surface 101L. The third surface 101*c* is inclined upward toward the separation nip 130.

That is, the third surface 101*c* and the first surface 101L are concaved by being inclined downward toward a trough portion 101*d*, and the first surface 101L and the second surface 101R are bumped by being inclined toward a crest portion 101*b*. The third surface 101*c*, the first surface 101L, the second surface 101R and the guide surface 102*a* of the intermediate guide 102 compose a supporting surface 113 supporting the sheet. A first friction member 129 is provided on the first surface 101L of the manual feed tray 101 so as to face the pickup roller 121. The first friction member 129 includes a first friction surface 129*a* having a static friction coefficient greater than that of the supporting surface 113 of the tray unit 112. The first friction surface 129*a* is configured to be in contact with the pickup roller 121 through the long sheet LS placed on the tray unit 112 and prevents a lowermost sheet placed on the tray unit 112 from being conveyed following its upper sheet. It is noted that while FIGS. 2 through 4 for example illustrate the first friction member 129 and a second friction member 150 described later to be thicker than their actual thicknesses, they are thinned so as not to affect loading and conveyance of the sheet. The first friction member 129 may be even omitted.

When the long sheet LS is placed on the supporting surface 113 of the tray unit 112, the front end portion of the long sheet LS is supported by the manual feed tray 101 and the intermediate portion thereof is guided by the intermediate guide 102 so as to be curved upward. The rear end portion of the long sheet LS guided by the intermediate guide 102 is supported by the rear end tray 103. As for weight of the long sheet LS, the rear end tray 103 bears a part thereof on the rear end side and the tray unit 112 bears a rest of the weight. In a condition in which the leading edge of the long sheet LS abuts against the separation nip 130, a force of pushing the long sheet LS into the separation nip 130 (referred to as a 'push-in force' hereinafter) acts on the leading edge of the long sheet LS due to the weight and a reaction force of the long sheet LS. If the push-in force is greater than a frictional resistance of the separation nip 130, the leading edge of the long sheet LS moves through the separation nip 130, thus possibly causing a feeding failure.

Figure 4:
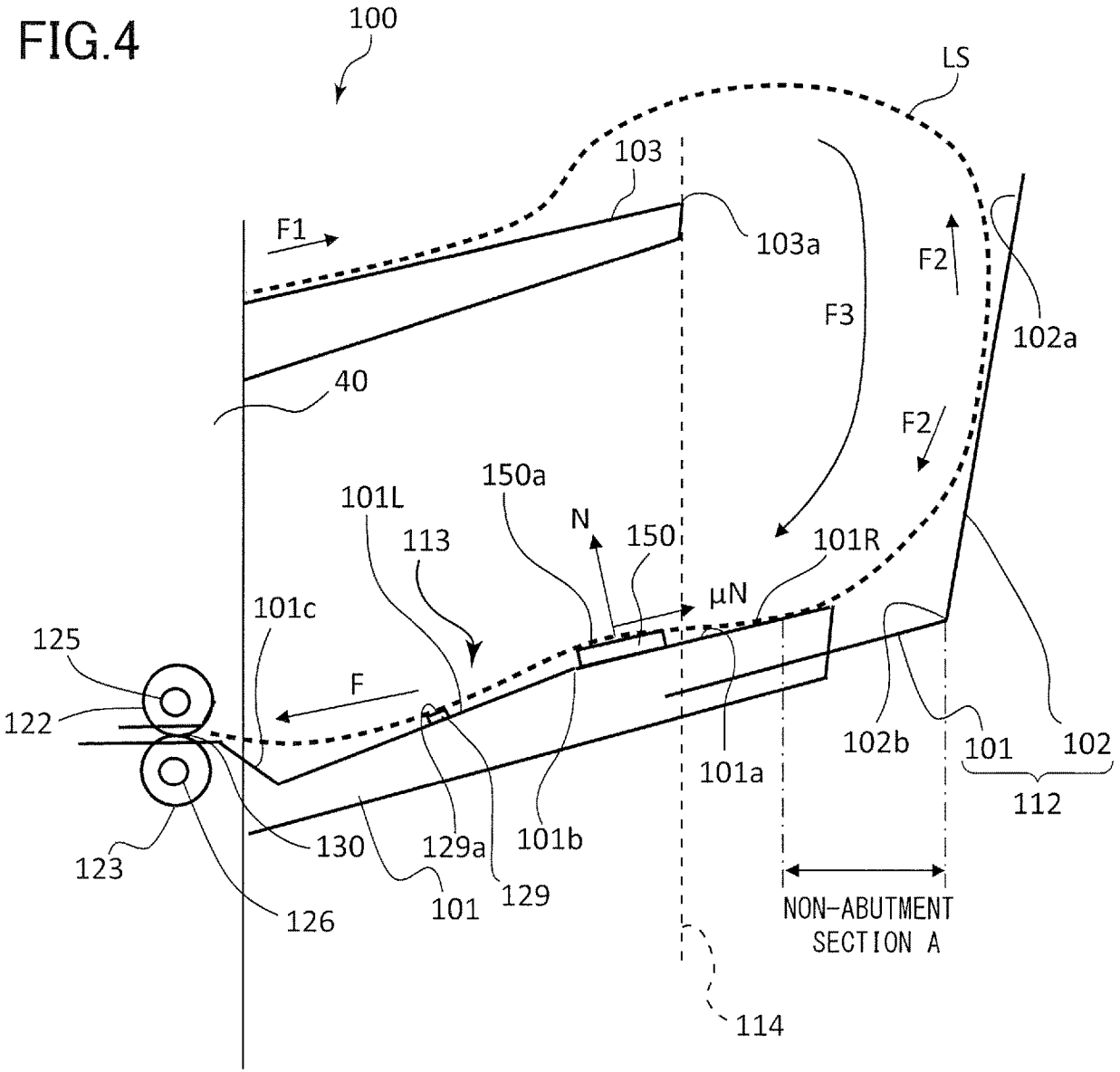
FIG. 4 illustrates forces acting on a long sheet.

Due to that, according to the present embodiment, the second friction member 150 is provided on the second surface 101R of the manual feed tray 101. The second friction member 150 includes a second friction surface 150*a* configured to be in contact with the long sheet LS placed on the tray unit 112. FIG. 4 illustrates distributions of forces acting on the long sheet LS. In a case where the a trailing edge of the long sheet LS abuts against the right door 40 as illustrated in FIG. 4, a force F1 acts on the rear end portion of the long sheet LS. A force F3 caused by the weight of the long sheet LS acts also on the long sheet LS toward the manual feed tray 101, and reaction forces F2 caused by the long sheet LS curved by the intermediate guide 102 also act on the long sheet LS. By being influenced by these forces, the push-in force F toward the separation nip 130 acts on the front end portion of the long sheet LS.

Meanwhile, a normal force N is generated between the second friction member 150 and the long sheet LS by the force F3, and a friction force μN in a direction inverse to the push-in force F acts on the long sheet LS. It is noted that the static friction coefficient μ of the second friction member 150 is set to be higher than that of a static friction coefficient of the supporting surface 113 of the tray unit 112. The second friction member 150 is formed of a rubber material or a suede material into a sheet-liked shape along the supporting surface 113 for example. The push-in force F acting on the long sheet LS is reduced by such friction force μN. It is also possible to reduce the push-in force F acting on the front end portion of the long sheet LS by curving the long sheet LS downward by the concave portion formed by the third surface 101*c* and the first surface 101L. Therefore, this arrangement makes it possible to prevent the front end portion of the long sheet LS from moving through the separation nip 130 and to reduce the occurrence of feeding failure. It is also possible to reduce damage such as a bend otherwise caused at the leading edge of the sheet by mitigating the push-in force F when the leading edge abuts against the abutment member 160 (see FIG. 5).

Disposition of Second Friction Member

Next, a position where the second friction member 150 is effectively disposed will be described. It is preferable to increase the normal force N in order to increase the frictional resistance caused by the second friction member 150 to reduce the push-in force F. Accordingly, preferably the second friction member 150 is disposed at a position where the normal force N is maximized.

Figure 5:
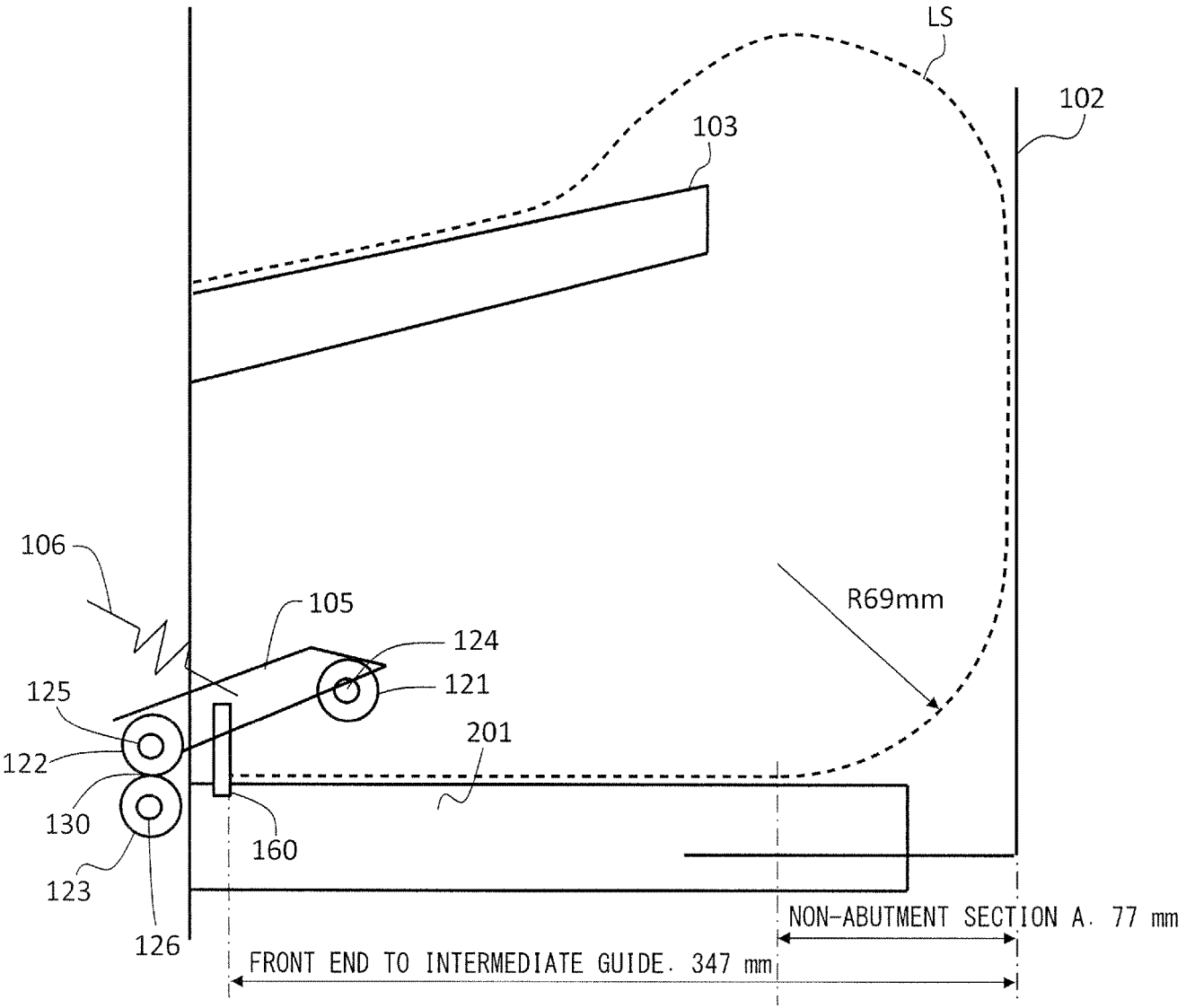
FIG. 5 is a schematic diagram illustrating a first reference example.
Figure 6:
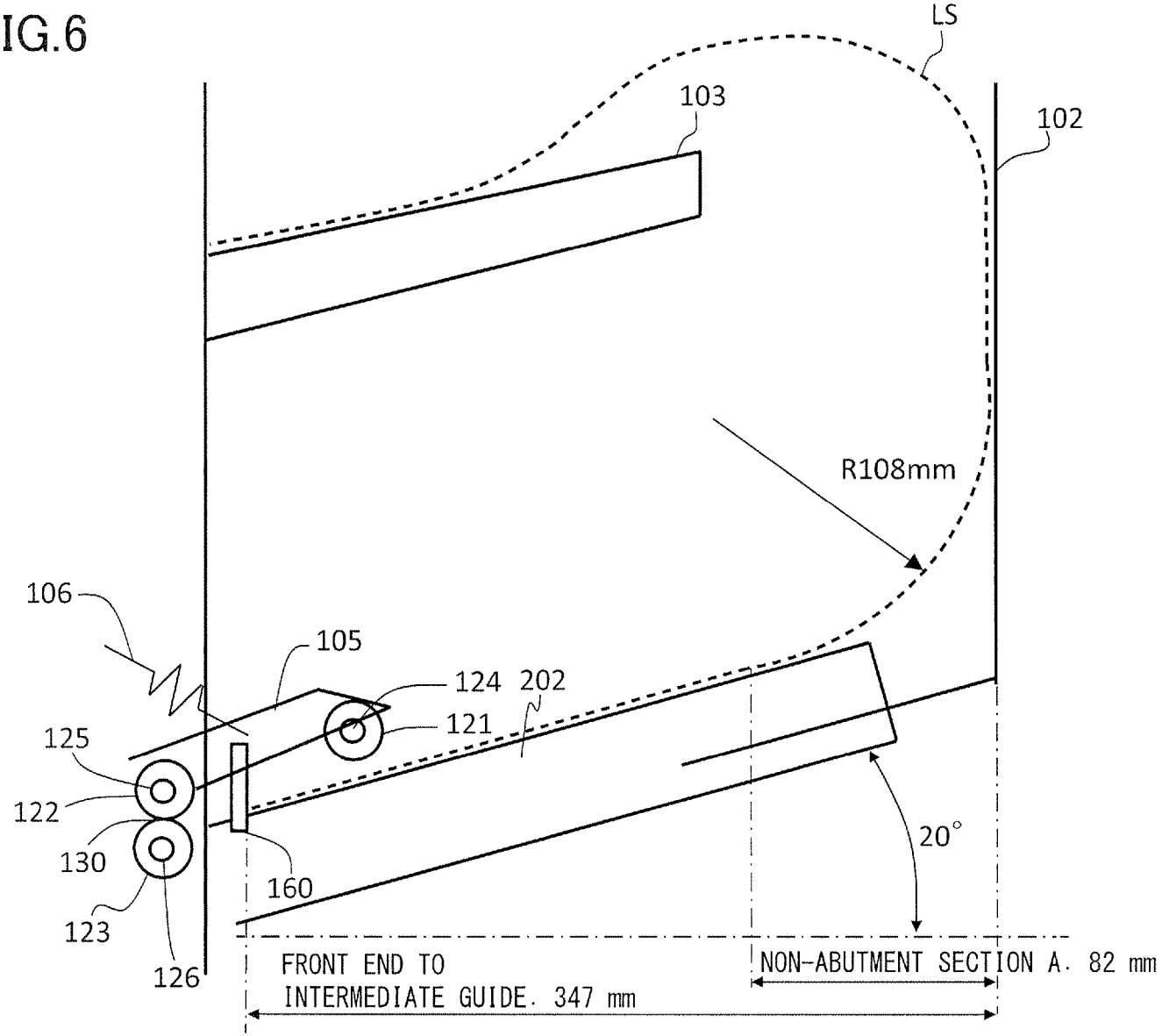
FIG. 6 is a schematic diagram illustrating a second reference example.

Here, first and second reference examples of the present embodiment will be described with reference to FIGS. 5 and 6. FIG. 5 illustrates the first reference example in which a manual feed tray 201 is provided along a horizontal direction. FIG. 6 illustrates the second reference example in which a manual feed tray 202 is provided by being inclined by 20 degrees with respect to the horizontal direction.

In the first and second reference examples, an abutment member 160 is provided upstream in the sheet feeding direction of the separation nip 130. The abutment member 160 is moved in linkage with the up and down movements of the feed arm 105 by a link mechanism not illustrated. That is, when the feed arm 105 is located at an ascent position, the abutment member 160 abuts against the sheet and restricts the sheet from moving in the sheet feeding direction. When the feed arm 105 is located at a descent position, the abutment member 160 sets back from the conveyance path and does not restrict the movement of the sheet.

In a condition in which the long sheet LS placed on the manual feed tray 201 is guided by the intermediate guide 102 so as to be curved upward as illustrated in FIG. 5, the long sheet LS floats in air around a part where the manual feed tray 201 is connected with the intermediate guide 102. Due to that, there exists a non-abutment section A where the long sheet LS does not abut with the manual feed tray 201 nor the intermediate guide 102. The following table indicates one example of a relationship between the non-abutment section A and a curvature R of the curved portion of the long sheet LS in a case where a long sheet LS of 128 gsm of basis weight and 900 mm in length is loaded on the manual sheet feeding tray in each of the first and second reference examples. It is noted that "FRONT END TO INTERMEDIATE GUIDE" indicates a horizontal distance from the abutment member 160 to the intermediate guide 102, and the non-abutment section A is also indicated by a horizontal distance.

TABLE 1

| | FRONT END TO INTERMEDIATE GUIDE | NON-ABUTMENT SECTION A | CURVATURE R |
|---|---|---|---|
| FIRST REFERENCE EXAMPLE (FIG. 5) | 347 mm | 77 mm | R69 mm |
| SECOND REFERENCE EXAMPLE (FIG. 6) | 347 mm | 82 mm | R108 mm |

As indicated in Table 1, a distance of the non-abutment section A is differentiated by the inclination angle of the manual sheet feeding tray. Then, considering a horizontal width dimension and a sheet type used and others required for the printer 1 of the present embodiment, the non-abutment section A is a distance less than a quarter of the horizontal distance from the abutment member 160 to the intermediate guide 102.

Suppose a case where the second friction member 150 is provided within the non-abutment section A, no force acts on the second friction member 150 from the long sheet LS and no normal force N is generated. Accordingly, the second friction member 150 is provided downstream in the sheet feeding direction of the non-abutment section A. That is, as illustrated in FIG. 4, it is desirable to provide the second friction member 150 on the supporting surface 113 at the position separated from a downstream end 102*b* in the sheet feeding direction of the intermediate guide 102 by a distance equal to or more than a quarter of the horizontal distance from the abutment member 160 to the intermediate guide 102.

Still further, as illustrated in FIG. 3, the posture of the long sheet LS is determined by an abutment portion of the pickup roller 121 with the manual feed tray 101 and the separation nip 130 downstream in the sheet feeding direction of the pickup roller 121. Therefore, in a case where the manual feed tray 101 is concaved downstream in the sheet feeding direction of the pickup roller 121 like the present embodiment in particular, the normal force N is hardly generated even if the second friction member 150 is provided downstream of the pickup roller 121. Accordingly, it is desirable to provide the second friction member 150 upstream in the sheet feeding direction of the pickup roller 121.

In addition, in a case where the manual feed tray 101 is bumped toward the crest portion 101*b*, the force from the long sheet LS is liable to act around the crest portion 101*b*. In particular, the force is liable to act in a vicinity of the crest portion 101*b* of the second surface 101R extending in a direction intersecting with a sheet feeding direction 170 (direction indicated by a two-dot chain line in FIG. 3) formed by the abutment of the pickup roller 121 and the first surface 101L of the manual feed tray 101. Accordingly, the second friction member 150 is disposed on a side, close to the first surface 101L, of the second surface 101R.

As illustrated also in FIGS. 3 and 4, the second friction member 150 is provided at a position close to the pickup roller 121 from a straight line 114 extending in a vertical direction by passing through a distal end 103*a* of the rear end tray 103. That is, at least a part of the second friction member 150 is provided at the position horizontally closer to the pickup roller 121 than the distal end 103*a* of the rear end tray 103.

As described above, it is possible to reduce the push-in force F by the friction force μN of the second friction member 150 and to reduce feeding failure regardless of sheet type by disposing the second friction member 150 at the adequate position of the tray unit 112. It is also possible to reduce damage such as a bend otherwise caused at the leading edge of the sheet by mitigating the push-in force F.

Second Embodiment

Next, a second embodiment of the present disclosure will be described. The second embodiment is configured by forming the second friction member 150 of the first embodiment differently. Due to that, the same components with those of the first embodiment will not be illustrated or denoted by the same reference numerals.

Figure 7:
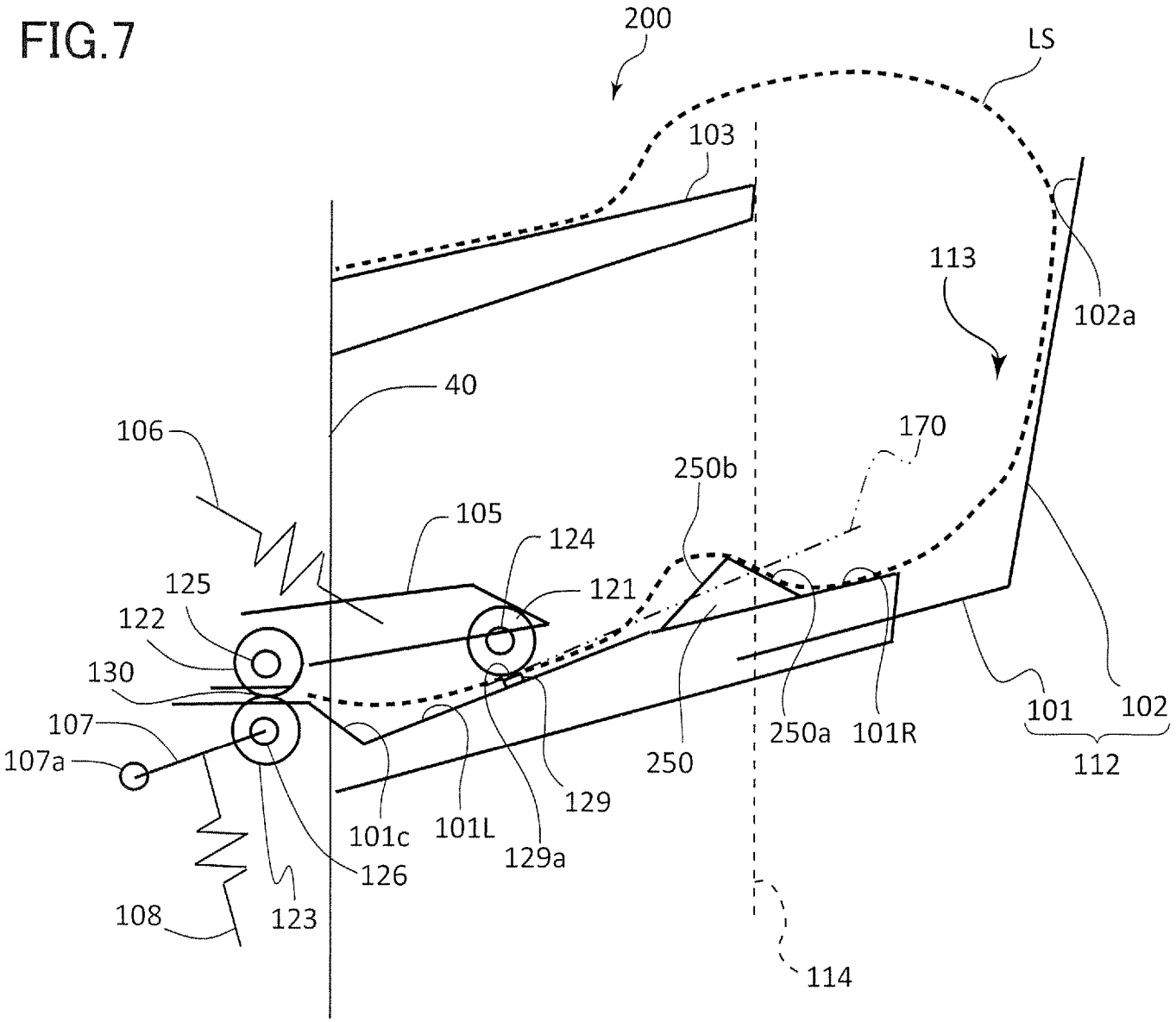
FIG. 7 is a side view of a manual sheet feeding apparatus of a second embodiment.

As illustrated in FIG. 7, a second friction member 250 of the manual sheet feeding apparatus 200 is provided on the second surface 101R of the manual feed tray 101 as described in the first embodiment concerning its disposition. The second friction member 250 includes first and second slopes 250*a* and 250*b* that project upward from the second surface 101R composing a part of the supporting surface 113 of the tray unit 112. The first slope 250*a* is inclined so as to separate from the second surface 101R toward downstream in the sheet feeding direction. The second slope 250*b* is disposed downstream of the first slope 250*a* in the sheet feeding direction and is inclined so as to approach the second surface 101R toward downstream in the sheet feeding direction. That is, the first and second slopes 250*a* and 250*b* project in a hill shape from the second surface 101R of the manual feed tray 101.

The first slope 250*a* serving as a second friction surface of the second friction member 250 extends so as to intersect with the sheet feeding direction 170 (direction indicated by a two-dot chain line in FIG. 7) and can receive the weight of the long sheet LS. This arrangement also makes it possible to reduce the push-in force F of the long sheet LS (see FIG. 4) and to reduce an occurrence of feeding failure.

Third Embodiment

Next, a third embodiment of the present disclosure will be described. The third embodiment is configured by changing the position of the second friction member 150 of the first embodiment. Due to that, the same components with those of the first embodiment will not be illustrated or denoted by the same reference numerals.

Figure 8:
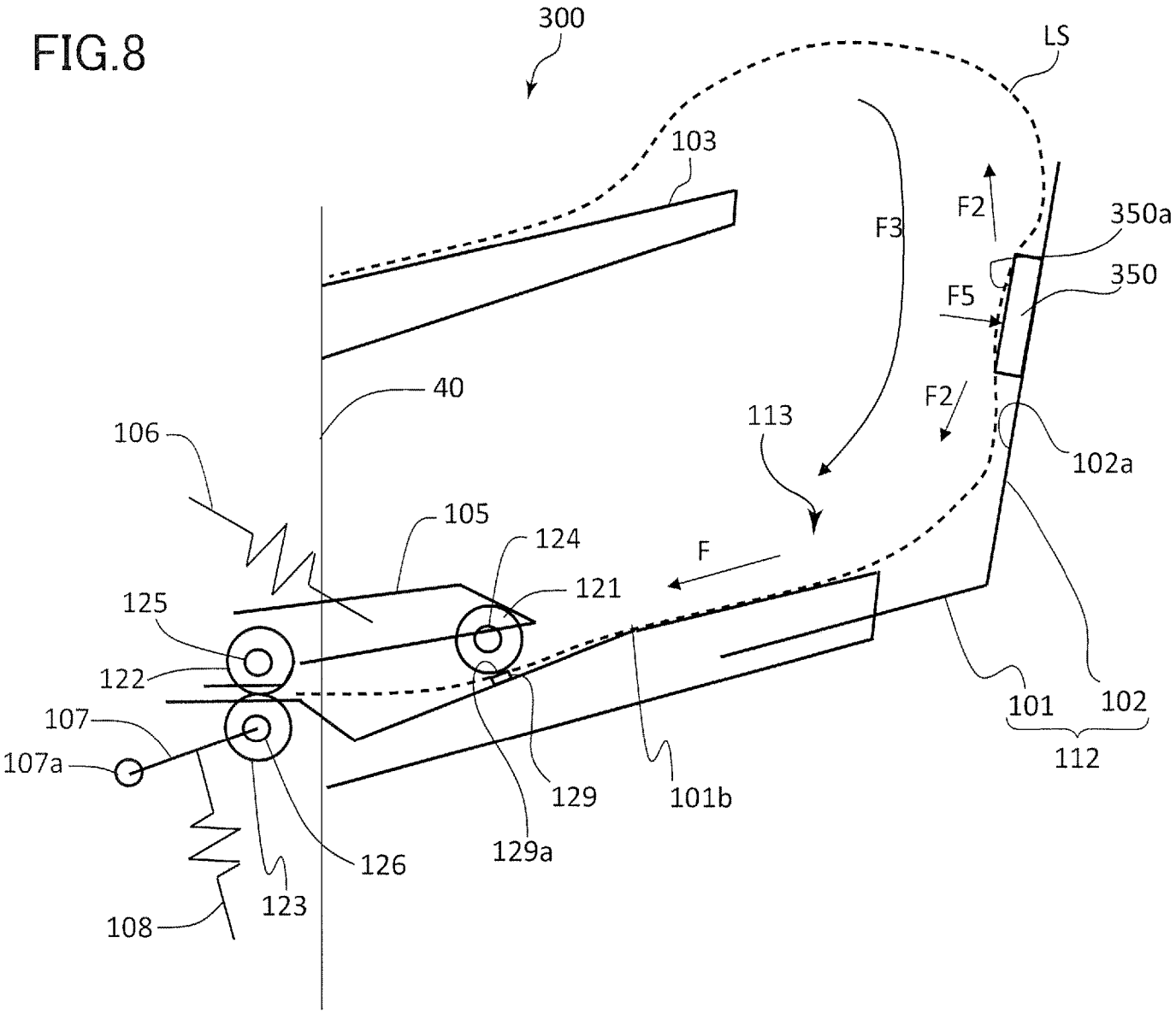
FIG. 8 is a side view of a manual sheet feeding apparatus of a third embodiment.

As illustrated in FIG. 8, a sheet-like second friction member 350 of a manual sheet feeding apparatus 300 is disposed on the guide surface 102*a* of the intermediate guide 102. The long sheet LS generates reaction forces F2 by being curved by the intermediate guide 102 and presses the intermediate guide 102 by a pressing force F5. Due to that, the second friction member 350 provided on the intermediate guide 102 applies frictional resistance to the long sheet LS based on the pressing force F5. This frictional resistance makes it possible to reduce the push-in force F of the long sheet LS and to reduce an occurrence of feeding failure.

Figure 9:
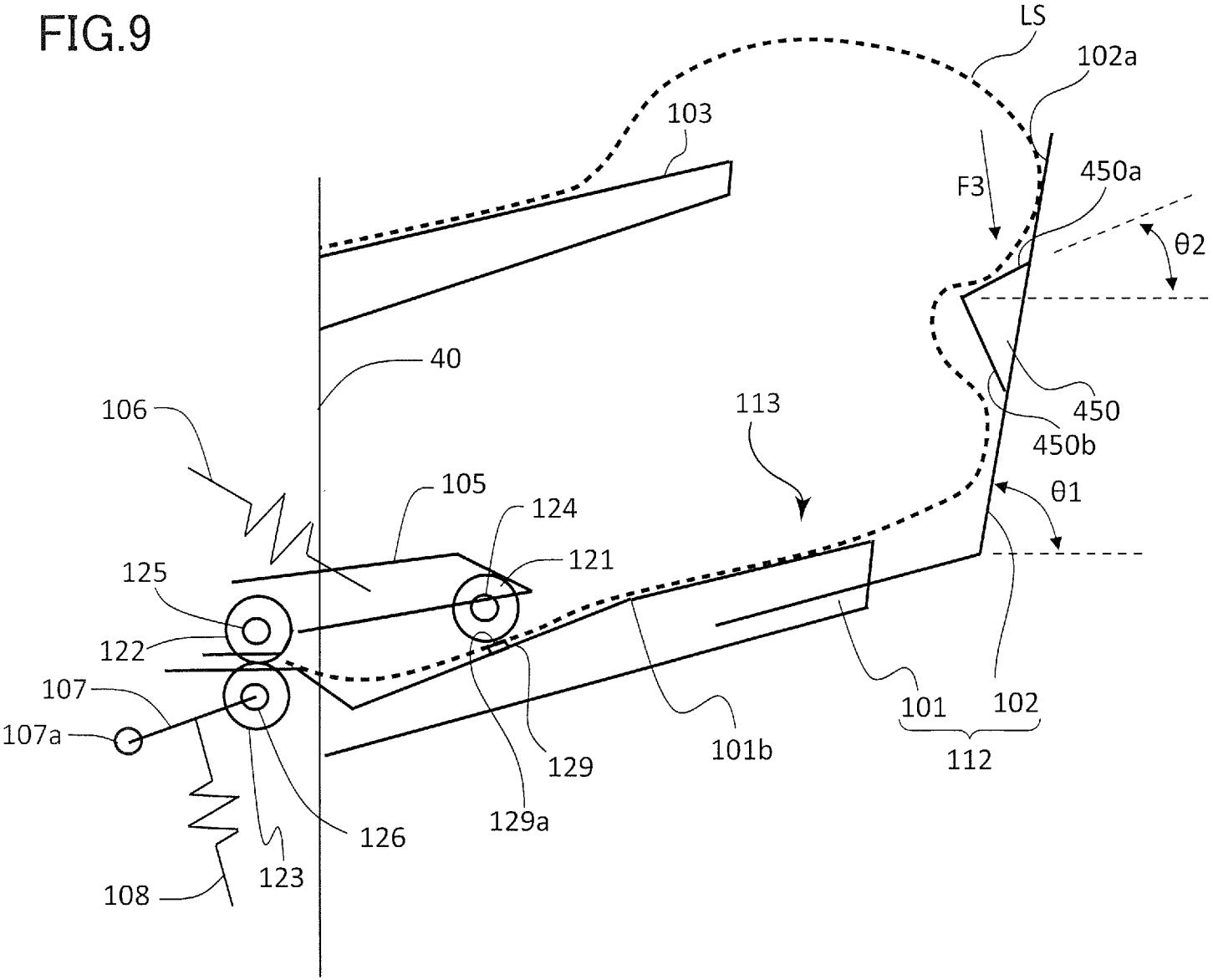
FIG. 9 is a side view illustrating a modified example of the manual sheet feeding apparatus of the third embodiment.

It is noted that as illustrated in FIG. 9, a hill type second friction member 450 may be provided on the intermediate guide 102 so as to project out of the guide surface 102*a* in the same manner as described in the second embodiment. Similarly to the second embodiment, the second friction member 450 serving as a resistant portion includes first and second slopes 450*a* and 450*b*. That is, the first slope 450*a* is inclined so as to separate from the guide surface 102*a* toward downstream in the sheet feeding direction. The second slope 450*b* is disposed downstream of the first slope 450*a* in the sheet feeding direction and is inclined so as to approach the guide surface 102*a* toward downstream in the sheet feeding direction. The first slope 450*a* is inclined by an angle θ2 with respect to the horizontal direction. Then, the guide surface 102*a* of the intermediate guide 102 is inclined by an angle θ1 which is greater than the angle θ2 with respect to the horizontal direction. Due to that, this arrangement makes it possible for the first slope 450*a* to receive a part of the force F3 caused by the weight of the long sheet LS and to reduce the push-in force of the long sheet LS together with the frictional resistance caused by the push-in force F5. Thereby, the occurrence of feeding failure of the long sheet LS can be reduced. Off course, it is also desirable to provide the second friction member 450 at a place coming into contact with the long sheet LS by considering characteristics of the long sheet LS and a shape of the intermediate guide 102. Still further, the second friction surface having a greater static friction coefficient than that of the supporting surface 113 may need not to be provided at the first slope 450*a*, and the second friction member 450 may be formed of a same material with the manual feed tray 101 and the intermediate guide 102 for example. The second friction member 450 may be also configured integrally with the intermediate guide 102.

It is noted that the second friction members 150, 250, 350 and 450 may be provided attachably/detachably to the tray unit 112 in any of the embodiments described above. For instance, the second friction members 150, 250, 350 and 450 may be attached to the tray unit 112 by means of seal, snap-fit, a screw and others. Still further, a plurality of attachment holes may be provided through the tray unit 112 such that a position for attaching the second friction member can be moved by attaching the second friction member selectively to the plurality of attachment holes. Still further, the material and the shape of the second friction surface where the second friction member comes into contact with the long sheet may be differentiated or a plurality of second friction members may be provided depending on a size and a basis weight of the long sheet LS.

Still further, in terms of the material of the second friction members 150, 250, 350 and 450, the whole second friction member needs not be one having a static friction coefficient higher than that of the tray unit 112, and just a static friction coefficient of the second friction surface needs to be higher than that of the supporting surface 113 of the tray unit 112. The material of the second friction surface is not limited to be the rubber or suede material as long as its static friction coefficient is higher than the supporting surface 113.

The shape of the manual feed tray 101 is also not limited and needs not have the first surface 101L, the second surface 101R and the third surface 101*c* as described in the embodiments. Still further, although the leading edge of the sheet placed on the tray unit 112 abuts against the abutment member 160, the present disclosure is not limited to such configuration. For instance, the abutment member 160 may not be provided, and the separation nip 130 may abut against the leading edge of the sheet placed on the tray unit 112. In these cases, the separation nip 130 or the sheet may be placed on the tray unit 112 in a condition in which the leading edge of the sheet abuts against the abutment member 160. The sheet placed on the manual feed tray 101 may be held in a condition in which the leading edge thereof abuts against not the separation nip 130 but against the third surface 101*c*. In this case, the third surface 101*c* composes an abutment portion against which the leading edge of the sheet abuts.

Still further, while the manual sheet feeding apparatus 100 is configured to feed the sheet by the pickup roller 121 in any of the embodiments described above, the present disclosure is not limited to such configuration. That is, instead of providing the pickup roller 121, a lifetable intermediate plate may be provided in the manual feed tray 101, and the sheet may be fed by the feed roller 122 by abutting the sheet with the feed roller 122 by lifting this intermediate plate.

Still further, while the present disclosure has been described by using the electro-photographic printer 1 in any of the embodiments described above, the present disclosure is not limited to such case. For instance, the present disclosure is applicable to an ink jet type image forming apparatus forming an image on a sheet by discharging ink droplets from a nozzle.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-168072, filed Aug. 31, 2017, which is hereby incorporated by reference herein in its entirety.

What is claimed is:

1. A sheet feeding apparatus comprising:

a sheet supporting portion comprising a supporting surface configured to support a sheet;

an abutment portion against which a leading edge of the sheet supported by the supporting surface abuts;

a feeding rotator configured to feed the sheet supported by the supporting surface and abutting against the abutment portion in a sheet feeding direction;

a first friction member provided on the supporting surface so as to face the feeding rotator, the first friction member comprising a first friction surface having a static friction coefficient greater than that of the supporting surface;

a trailing end supporting portion configured to support a trailing end portion of the sheet; and a second friction member disposed upstream of the first friction member in the sheet feeding direction on the supporting surface, the second friction member comprising a second friction surface which has a static friction coefficient greater than that of the supporting surface and is configured to be in contact with the sheet supported by the supporting surface, wherein the sheet supporting portion comprises a first tray configured to support a sheet and an intermediate guide configured to guide the sheet so as to be curved upward between the first tray and the trailing end supporting portion.

2. The sheet feeding apparatus according to claim 1, wherein the second friction member is formed into a sheet shape along the supporting surface.

3. The sheet feeding apparatus according to claim 1, wherein the second friction member comprises a first slope inclined so as to separate from the supporting surface toward downstream in the sheet feeding direction and a second slope disposed downstream of the first slope in the sheet feeding direction and inclined so as to approach the supporting surface toward downstream in the sheet feeding direction.

4. The sheet feeding apparatus according to claim 1, wherein the second friction member is provided on the first tray at a position separated from a downstream end in the sheet feeding direction of the intermediate guide by a distance equal to or greater than a quarter of a horizontal distance from the abutment portion to the intermediate guide.

5. The sheet feeding apparatus according to claim 1, wherein the trailing end supporting portion is a second tray disposed so as to overlap with the first tray when viewed in a vertical direction, and at least a part of the second friction member is provided at a position horizontally closer to the feeding rotator than a distal end of the second tray is to the feeding rotator.

6. The sheet feeding apparatus according to claim 1, wherein the first tray comprises a first surface disposed under the feeding rotator and inclined downward toward the abutment portion and a second surface disposed upstream of the first surface in the sheet feeding direction and inclined downward toward the abutment portion with an inclination angle smaller than that of the first surface, and the second friction member is disposed on a side, close to the first surface, of the second surface.

7. The sheet feeding apparatus according to claim 6, wherein the first tray comprises a third surface disposed downstream of the first surface in the sheet feeding direction and is inclined upward toward the abutment portion.

8. The sheet feeding apparatus according to claim 1, wherein the second friction member is provided on the intermediate guide.

9. The sheet feeding apparatus according to claim 1, wherein the second friction member is removably attached to the supporting surface.

10. The sheet feeding apparatus according to claim 1, further comprising a separating portion comprising a separation nip where the sheet fed by the feeding rotator is separated from another sheet, wherein the abutment portion is the separation nip.

11. The sheet feeding apparatus according to claim 1, wherein the second friction member is formed of a rubber material or a suede material.

12. An image forming apparatus comprising:

the sheet feeding apparatus as set forth in claim 1; and an image forming portion configured to form an image on a sheet fed from the sheet feeding apparatus.

13. A sheet feeding apparatus comprising:

a first tray configured to support a sheet;

an abutment portion against which a leading edge of the sheet supported by the first tray abuts;

a feeding rotator configured to feed the sheet supported by the first tray and abutting against the abutment portion in a sheet feeding direction;

a second tray configured to support a trailing end portion of the sheet supported by the first tray;

an intermediate guide comprising a guide surface configured to guide the sheet so as to be curved upward between the first tray and the second tray; and a resistant portion provided on the intermediate guide so as to project out of the guide surface, wherein the resistant portion comprises a first slope inclined so as to separate from the guide surface toward downstream in the sheet feeding direction and a second slope disposed downstream of the first slope in the sheet feeding direction and inclined so as to approach the guide surface toward downstream in the sheet feeding direction, and the first slope receives a part of a force caused by a weight of the sheet supported by the first tray and the second tray.

14. The sheet feeding apparatus according to claim 13, further comprising a separating portion comprising a separation nip where the sheet fed by the feeding rotator is separated from another sheet, wherein the abutment portion is the separation nip.

15. An image forming apparatus comprising:

the sheet feeding apparatus as set forth in claim 13; and an image forming portion configured to form an image on a sheet fed from the sheet feeding apparatus.

* * * * *